US005940032A

United States Patent [19]

Passmann et al.

[11] Patent Number: 5,940,032

[45] Date of Patent: Aug. 17, 1999

[54] METHOD AND DEVICE FOR CALIBRATING A GROUP ANTENNA

[75] Inventors: Christian Passmann, Nordstemmen; Thomas Wixforth, Hildesheim, both of Germany

[73] Assignee: Robert Bosch GmbH, Stuttgart, Germany

[21] Appl. No.: 09/238,660

[22] Filed: Jan. 26, 1999

[30] Foreign Application Priority Data

Feb. 19, 1998 [DE] Germany ..... 198 06 914

[51] Int. Cl.[6] ..... H01Q 3/22; H01Q 3/24; H01Q 3/26

[52] U.S. Cl. ..... 342/372; 342/174; 342/165

[58] Field of Search ..... 342/174, 165, 342/372, 373

[56] References Cited

U.S. PATENT DOCUMENTS

| | | | |
|---|---|---|---|
| 5,412,414 | 5/1995 | Ast et al. | 342/174 |
| 5,530,449 | 6/1996 | Wachs et al. | 342/174 |
| 5,543,801 | 8/1996 | Shawyer | 342/354 |

FOREIGN PATENT DOCUMENTS

| | | |
|---|---|---|
| 0 578 060 A2 | 1/1994 | European Pat. Off. . |
| 195 35 441 A1 | 3/1997 | Germany . |
| WO 95/34103 | 12/1995 | WIPO . |

OTHER PUBLICATIONS

Ernest J. Wilkinson "An N–Way Hybrid Power Divider", IRE Transactions on Microwave Theory and Techniques, Jan. 1960.

*Primary Examiner*—Theodore M. Blum
*Attorney, Agent, or Firm*—Michael J. Striker

[57] ABSTRACT

A method and apparatus for calibrating transmission and reception paths of a group antenna with an adaptive radiation pattern is provided, in which one transmission signal after the other is transmitted over each transmission path (DA1, . . . ,DAN; Tx1, . . . ,TxN; DP1, . . . ,DPN), a signal portion is decoupled from each transmission signal and the decoupled portion of at least one transmission signal is divided into as many equal parts of equal strength and equal phase as reception paths present. These equal parts of the decoupled transmission signal portion are coupled into the respective reception paths and the strengths and phases of the equal parts transmitted over the respective reception paths (DP1, . . . ,DPN; Rx1, . . . ,RxN; AD1, . . . ,ADN) are measured. The transmission factors of all other ones transmission paths and reception paths are determined from known transmission factor values for them and the measured strengths and phases of the equal parts of the at least one transmission path. Deviations of the resulting transmission factors are compensated by changing weighting factors of a radiation pattern network (Tx-BFN, Rx-BFN).

6 Claims, 2 Drawing Sheets

METHOD AND DEVICE FOR CALIBRATING A GROUP ANTENNA

BACKGROUND OF THE INVENTION

Field of the Invention

The present invention relates to a method and device for calibrating a transmission path and reception path of a group antenna with an adaptive radiation pattern. A group antenna with an adaptive radiation pattern is, e.g., described in European Patent Document EP 0 578 060 A2 or German Patent Document DE 195 35 441 A1. The radiation pattern or radiation variations of the transmission and/or reception characteristics are measured with the help of a radiation pattern network, in which the transmitted and received signals of the individual antenna elements are multiplied according to the desired antenna characteristics with different weighting factors. This type of group antenna with an adaptive radiation pattern can for example be used in a cellular mobile radio system or a point-to-multipoint radio broadcast system.

The radiation pattern can be corrupted or adulterated by errors in the signal path of the individual antenna elements. Errors in the signal paths can be caused, e.g., by production tolerances or temperature drift or alterations, etc. Degradation of the desired radiation pattern can be reduced by calibrating the signal path between the radiation pattern network and the individual antenna elements.

SUMMARY OF THE INVENTION

It is an object of the present invention to provide a method and device for calibrating a group antenna of the above-described kind, whereby a calibration of the transmission and reception path of the group antenna can be performed.

The method for calibrating the transmission and reception paths of a group antenna with an adaptive radiation pattern comprises:

a) sending one transmission signal after the other over each of the transmission paths present;

b) decoupling a transmission signal portion from each of the transmission signals;

c) dividing the transmission signal portion of at least one of the transmission signals into as many equal parts of equal strength and equal phase as reception paths present;

d) coupling these equal parts of the transmission signal portion into the respective reception paths for the at least one transmission signal;

e) measuring the strengths and phases of the equal parts transmitted over the respective reception paths for the at least one transmission signal;

f) determining transmission factors of all other ones transmission paths and reception paths from known values of the transmission factors for the respective other transmission and reception paths and the measured strengths and phases of the equal parts transmitted over the respective reception paths; and g) compensating deviations of the transmission factors determined in step f) from the measured strengths and phases by changing weighting factors in a radiation pattern network.

The device according to the invention for calibrating the transmission and reception paths of a group antenna with an adaptive radiation pattern comprises control means for sending transmission signals over each transmission path present one after the other;

decoupling means for decoupling transmission signal portions from each transmission signal;

dividing means for dividing said transmission signal portions from each of said transmission signals into as many respective equal parts having equal amplitudes and phases as reception paths present;

coupling means for coupling the equal parts of at least one transmission signal into the respective reception paths;

wherein the control means also includes:

means for measuring the strengths and phases of the equal parts transmitted over the respective reception paths for the at least one transmission signal;

means for determining transmission factors of all other transmission paths and reception paths from known values of the transmission factors for the respective other transmission and reception paths and the measured strengths and phases of the equal parts transmitted over the respective reception paths; and means for compensating deviations of the measured transmission factors derived from the measured strength and phase by changing weighting factors of a radiation pattern network.

The method and device according to the invention permit a calibration of the group antenna, even during its operation.

Advantageous embodiments of the invention are described in more detail hereinbelow.

In a frequency duplex broadcast system, in which a frequency shift exists between the transmission and reception paths, the signal parts coupled into the reception paths in the method of the invention are converted at the frequencies used in the corresponding reception paths.

The division of a transmitted signal into equal signal parts with respect to strengths and phases is performed advantageously with a Wilkinson divider, which is provided with a reflection termination on its central gate. If the coupling of the individual antenna elements is different from each other, a conversion from a reflection termination to an absorbing termination is provided.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
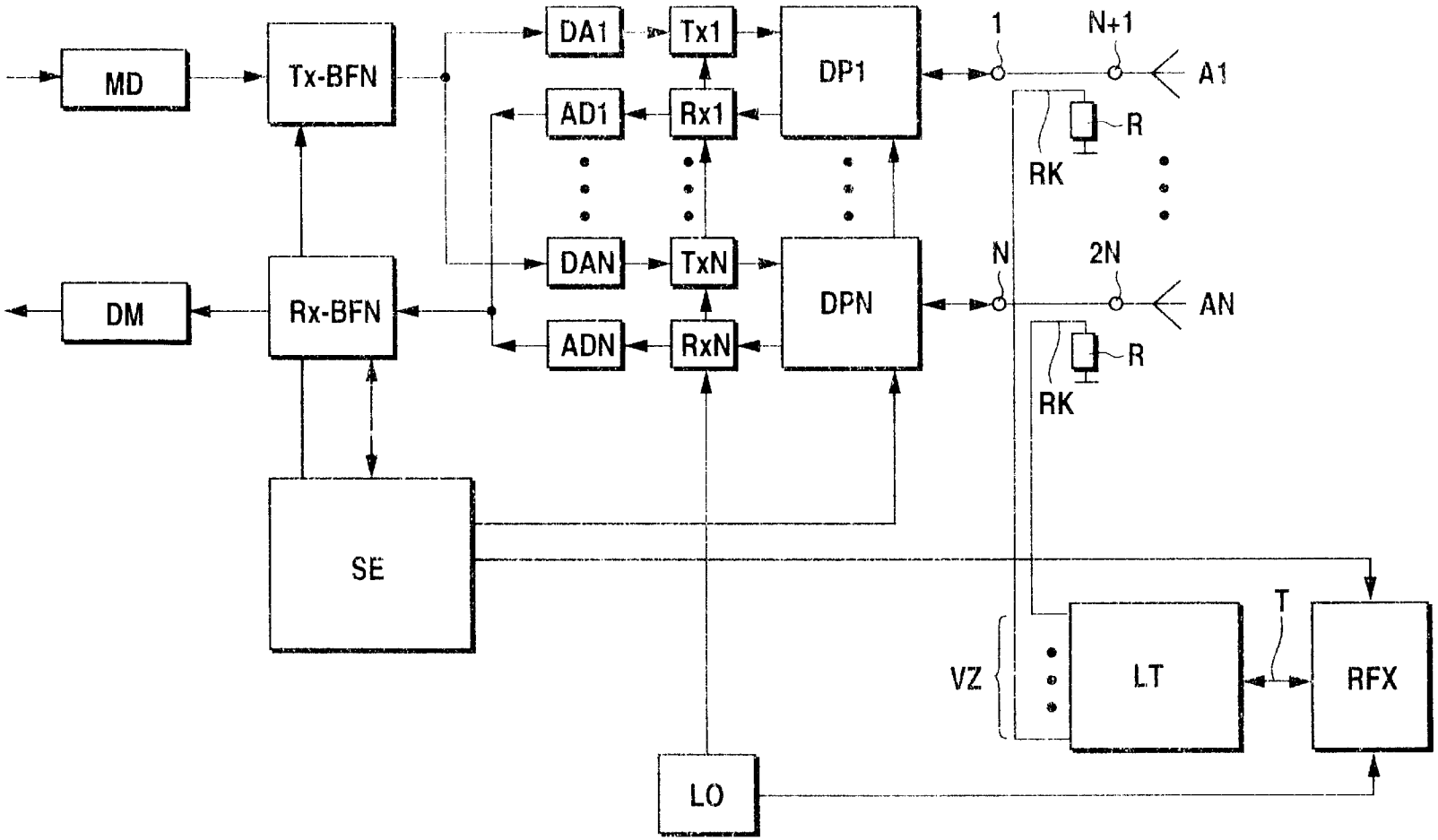
FIG. 1 is a block diagram of a duplex broadcasting system with a group antenna.

The duplex broadcasting system shown in FIG. 1 has N antenna elements A1, . . . ,AN of a group antenna. The antenna elements A1, . . . ,AN are each available for reception and also for transmission of signals. Each antenna element A1, . . . ,AN is connected to a duplexer DP1, . . . , DPN. The duplexer DP1, . . . ,DPN causes a transmission, in a known way, of a transmission signal from a transmitter Tx1, . . . ,TxN on one transmission path to the associated antenna element A1, . . . ,AN and the transmission, in a known, way of a received signal from one of the antenna elements A1, . . . ,AN to the respective receiver RX1, . . . , RxN on its reception path. All transmitters Tx1, . . . ,TxN and all receivers Rx1, . . . ,RxN receive a reference frequency from a local oscillator LO for phase control.

So that the signal processing before the transmitters Tx1, . . . ,TxN and after the receivers Rx1, . . . ,RxN occurs digitally in an appropriate manner, digital-analog converters DA1, . . . ,DAN are arranged in the transmission paths and analog-digital converters AD1, . . . ,ADN are arranged in the reception paths.

A radiation pattern network is provided for all transmitted signals and all received signals. This radiation pattern network is divided in two blocks according to FIG. 1, a block Tx-BFN for the transmission signals and a block Rx-BFN for the received signals. The operation of this radiation pattern network is not described here in further detail since it is known and described sufficiently in the above-cited prior art references.

A modulator MD is connected on the transmission side and a demodulator DM is connected on the reception side to the radiation pattern network blocks Tx-BFN and Rx-BFN.

A controller or control means SE controls the duplexers DP1, . . . DPN, which operate, for example, according to a time or frequency duplex process, and the weighting factors in the pattern network Tx-BFN, Rx-BFN. The control signals are indicated with the thick lines in FIG. 1.

The transmitted and received signals of the individual antenna elements A1, . . . ,An are degraded in their transmission and reception paths between the radiation pattern network Tx-BFN and Rx-BFN and the gates of the antenna elements A1, . . . ,AN by various error sources. These error sources can be, e.g., production tolerances, installation tolerances, temperature drift and thermal expansion of electrical high frequency conductors, aging or the like. If the errors in the transmission and reception paths effect the form of the antenna characteristic diagram, they can be compensated by suitable adjustment of the weighting factors in the radiation pattern network Tx-BFN and Rx-BFN.

The transmission factors, which means the transmission functions, of the transmission and reception paths of the individual antenna elements A1, . . . ,AN are measured and the deviations between the transmission factors for the reception and transmission paths due to the errors are compensated by suitable control of the weighting factors of the radiation pattern network Tx-BFN and Rx-BFN in the calibration process described in the following paragraphs.

Figure 2:
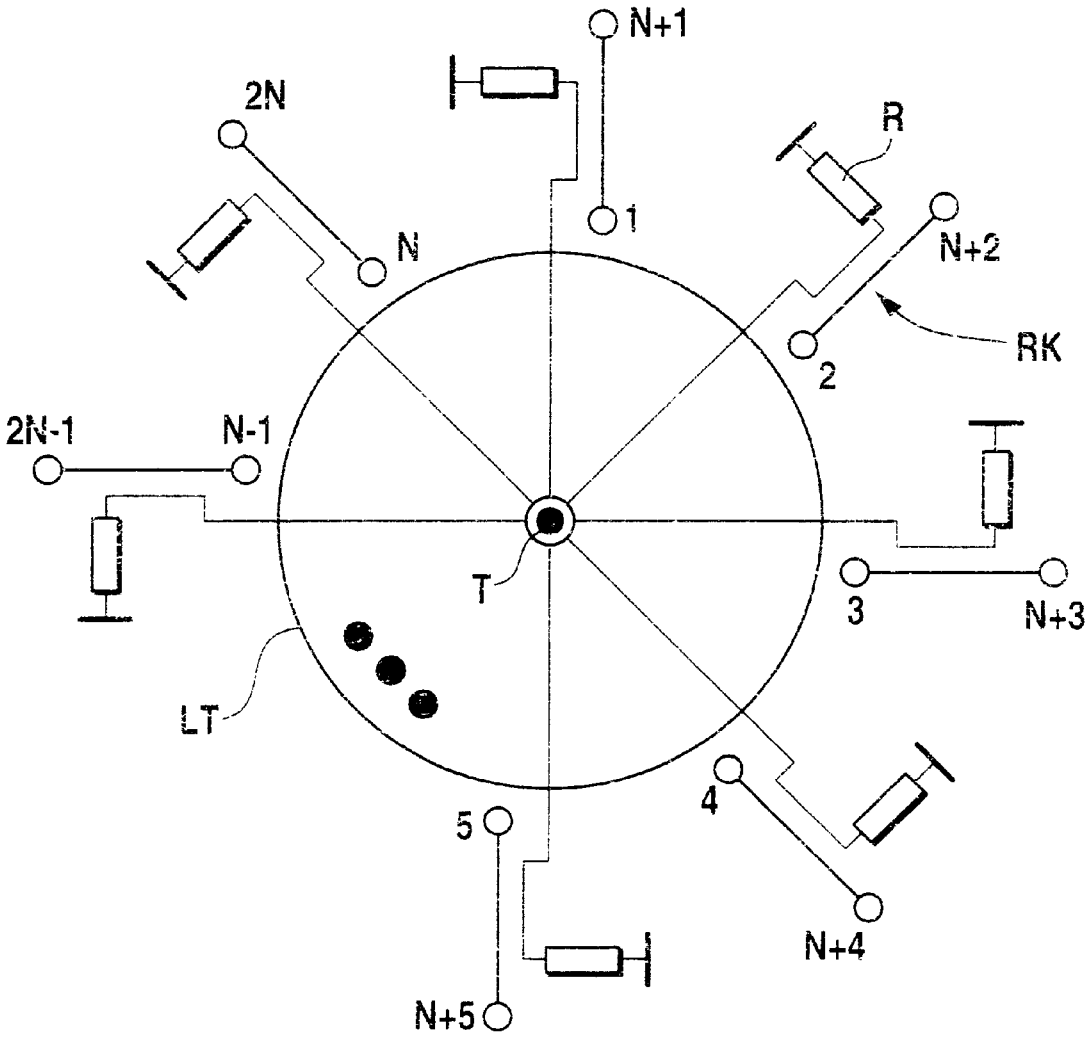
FIG. 2 is a diagrammatic illustration of the principle of operation of a Wilkinson divider.

The calibrating apparatus includes a coupling device with 2N gates that is provided in the signal paths between the antenna elements A1, . . . ,AN and the duplexers DP1, . . . DPN. The gates 1 to N of the coupling device are connected with the gates of the duplexers DP1, . . . DPN and the gates N+1 to 2N of the coupling device are connected with the gates of the antenna elements A1, . . . ,AN. The coupling device comprises N equal directional couplers RK, which are arranged in the signal paths between the antenna elements A1, . . . ,AN and the duplexer DP1, . . . ,DPN. The coupling gates of the directional couplers RK closest to the antenna elements A1, . . . ,AN are connected to a terminal resistance R. The coupling gates on the side closest to the duplexers DP1, . . . ,DPN are connected with the branch gates VZ of a power divider LT. This power divider LT is designed so that its branch gates VZ are connected with a central gate T by means of identical conductor networks. The main circuit diagram of one preferred embodiment for the power divider of the invention, a Wilkinson divider, is shown in FIG. 2. This power divider LT conducts all signals applied to the branch gates VZ, which are the equal amplitude and equal phase output signals of the directional couplers RK together to the central gate T; or it dividers a signal applied to the central gate T into equal parts in regard to amplitude and phase appearing at the branch gates VZ. The so-called Wilkinson divider, which fulfills the above-described prerequisites, is described in IRE Transactions on Microwave Theory and Techniques, January 1960, pp. 116 to 118.

The calibration process for the transmission and reception paths takes places as described in the following. A transmitted signal is sent over a transmission path i ($i\epsilon\{1 \ldots N\}$). The directional coupler RK decouples a portion of the transmitted signal upstream of the associated antenna element Ai. This transmitted signal portion is conducted to the central gate T of the power divider by means of the power divider. A reflecting termination RFX is connected to this central gate T. The transmitted signal portion is reflected at this reflection termination RFX and divided into equal amplitude and equal phase signal parts at the branch gates VZ. The number of branch gates (namely N) is equal to the number of reception paths. The individual signal parts derived from the transmitted signal are now coupled into the reception paths by means of the directional couplers RK. The signal parts received from the radiation pattern network block Rx-BFN at the outputs of the reception paths are evaluated or analyzed by the control means or device SE. Thus a total transmission $T_i(j\omega))*X_{ij}(j\omega)*R_j(j\omega)$ results in a signal route that includes the ith signal path, the coupler device RK, the power divider LT and the jth reception path, in which $T_i(j\omega)$ is the transmission factor of the ith transmission path, $R_j(j\omega)$ is the transmission factor of the jth reception path and $X_{ij}(j\omega)$ is the transmission factor of the coupling device RK, of the power divider LT and a normally unknown coupling between the antenna elements A1, . . . ,AN. Furthermore $i,j\epsilon\{1 \ldots N\}$. As has been said, the transmission factor $X_{ij}$ is derived from a transmission factor $C_{ij}(j\omega)$ ascribed to the coupling device and the power divider LT and the transmission factor $D_{ij}(j\omega)$ due to the coupling of the antenna elements. The transmission factor $C_{ij}(j\omega)$ is completely known exactly and equal for all i and j because the amplitudes and phases of the signal parts are equal so that $C_{ij}(j\omega)=C(j\omega)$.

Only when coupling of the antenna elements under each other occurs or this coupling is not negligible, the transmission factors must be determined in the following manner based on the antenna coupling in which $D_{ij}(j\omega)=D_{ji}(j\omega)$ (reciprocity can be assumed here). So that the transmission factor $D_{ij}(j\omega)$ can be determined, the termination at the central gate T of the power divider must be switchable from reflection to absorption. If it is switched to absorption, the transmission signal portion thus decoupled from the coupling device RK is absorbed and no signal parts are coupled back into the reception paths. The signals occurring in the reception path are exclusively ascribed to the coupling of the antenna elements. In this case the transmission factor $C(j\omega)$ plays no role. Then the following system of equations may be set up:

$$\begin{aligned} &T_i(j\omega)R_j(j\omega)D_{ij}(j\omega)=M_{ijD}(j\omega)) \\ &T_i(j\omega)R_j(j\omega)(C(j\omega)+D_{ij}(j\omega))=M_{ijCD}(j\omega) \\ &T_i(j\omega)R_i(j\omega)D_{ji}(j\omega)=M_{jiD}(j\omega) \\ &T_i(j\omega)R_i(j\omega)(C(j\omega)+D_{ji}(j\omega))=M_{jiCD}(j\omega) \end{aligned} \tag{1}$$

$i\neq j$ and $i,j\epsilon\{1, \ldots ,N\}$.

In this system of equations $M_{ijD}(j\omega)$ is the measured transmission factor over the transmission path i, the antenna coupling $D_{ij}(j\omega)$ and the reception path j, in which the termination at the central gate T of the power divider LT was switched to absorption. $M_{ijCD}(j\omega)$ is the measured transmission factor over the transmission path i, the antenna coupling $D_{ij}(j\omega)$, the definite coupling $C(j\omega)$) of the coupling device RK and of the power divider and the reception path j, in which the termination RFX at the central gate T is switched to reflection. The same goes for the transmission factors $M_{jiD}(j\omega)$) and $M_{jiCD}(j\omega)$.

The antenna coupling $D_{ij}(j\omega)$ can now be derived from the following equations (2) or (3):

$$D_{ij}(j\omega)=D_{ji}(j\omega)=C(j\omega)M_{ijD}(j\omega)/\{M_{ijCD}(j\omega)-M_{ijD}(j\omega)\} \quad (2)$$

$$D_{ji}(j\omega)=D_{ij}(j\omega)=C(j\omega)M_{jiD}(j\omega)/\{M_{jiCD}(j\omega)-M_{jiD}(j\omega)\}. \quad (3)$$

To determine all the transmission factors $T_i(j\omega)$, $R_j(j\omega)$ the transmission and reception paths must be assumed in which an arbitrary transmission factor $T_i(j\omega)$ or $R_j(j\omega)$ is known ($i\epsilon\{1 \ldots N)$ $N>2$). As many as $N(N-1)$ calibration measurements are performed; which means that one transmitted signal after the other is sent over each signal path and the transmitted signal portions decoupled from them are divided into equal signal parts after reflection at the reflection termination and these are fed back or coupled back into the respective individual reception paths. From the $N(N-1)$ calibration measurements now $N(N-1)$ equations of the following form may be setup:

$$T_i(j\omega)R_j(j\omega)(C(j\omega)+D_{ij}(j\omega))=M_{ijCD}(j\omega) \quad (4)$$

$i\neq j$ and $i,j\epsilon\{1, \ldots ,N\}$. Given that, for example, the transmission factor of the transmission path $T_n(j\omega)$ ($n\epsilon\{1 \ldots N\}$) is, for example, known, the transmission factors of the reception paths $R_j(j\omega)$ may be determined from the equation (4) with $i=n$ and $j\neq n$:

$$R_j(j\omega)=M_{njCD}(j\omega)/\{T_n(j\omega)\ (C(j\omega)+D_{nj}(j\omega))\}. \quad (5)$$

Furthermore the transmission factor $R_k(j\omega)$ ($k\neq n$) can be used in order to determine the transmission factors of the transmission paths $T_i(j\omega)(i\neq k)$:

$$T_i(j\omega)=M_{ikD}(j\omega)/\{R_k(j\omega)\ (C(j\omega)+D_{ik}(j\omega))\}. \quad (6)$$

In the above-described manner all the transmission factors $T_i(j\omega)$ of the transmission paths and all the transmission factors of the $R_j(j\omega)$ of the reception paths can be determined in relation to the known transmission factors $T_n(j\omega)$ or $R_n(j\omega)$. Furthermore the resulting deviations of the transmission factors of the transmission or reception paths are compensated by the control device SE by changing the weighting factors in the radiation pattern network Tx-BFN, Rx-BFN. Thus the effect of the errors in the transmission and reception paths on the radiation pattern is strongly reduced.

In the above-described system a time-duplex broadcast system is involved; which means signals are transmitted over the transmission and reception paths in equal frequency bands. By modification of the above-described calibration device it can also be used in a frequency duplex broadcast system in which the transmission and reception frequencies differ by a fixed frequency duplex spacing. Also the termination RFX must be provided with a mixer which converts the input signals for the duplex frequency spacing so that the reflected signal parts are in the frequency band of the reception paths. As shown in FIG. 1, the mixer is supplied with the local oscillator frequency LO, which is similarly supplied to the transmitters Tx1, . . . ,TxN and the receivers Rx1, . . . ,RxN, as a reference frequency.

The disclosure in German Patent Application 198 06 914.6 of Nov. 25, 1998 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a method and device for calibrating a transmission path and reception path of a group antenna with an adaptive radiation pattern, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

We claim:

1. A method for calibrating transmission and reception paths of a group antenna with an adaptive radiation pattern comprising the steps of:

a) sending one transmission signal after the other over each of the transmission paths present;

b) decoupling a portion from each of the transmission signals;

c) dividing the portion of at least one of the transmission signals into as many equal parts of equal strength and equal phase as reception paths present;

d) coupling said equal parts of the transmission signal portion into the respective reception paths for the at least one transmission signal;

e) measuring the strengths and phases of the equal parts transmitted over the respective reception paths for the at least one transmission signal;

f) determining transmission factors of all other ones transmission paths and reception paths from known values of the transmission factors for the respective other transmission and reception paths and the measured strengths and phases of the equal parts transmitted over the respective reception paths; and g) compensating deviations of the transmission factors determined in step f) from the measured strengths and phases by changing weighting factors of a radiation pattern network.

2. The method as defined in claim 1, further comprising converting the equal parts of the at least one transmission signal coupled into the reception paths at the frequencies of the corresponding reception paths when a frequency shift exists between the transmission and reception paths.

3. A device for calibrating transmission and reception paths of a group antenna with an adaptive radiation pattern comprising control means (SE) for sending transmission signals over each transmission path (DA1, . . . ,DAN; Tx1, . . . TxN; DP1, . . . ,DPN) present one after the other;

decoupling means (RK) for decoupling transmission signal portions from each transmission signal;

dividing means (LT) for dividing said transmission signal portions from each of said transmission signals into as many respective equal parts having equal amplitudes and phases as reception paths present; and coupling means (RK) for coupling the equal parts of at least one transmission signal into the respective reception paths (DP1, . . . ,DPN; RX1, . . . ,RXN; AD1, . . . ,ADN);

wherein the control means (SE) also includes means for measuring the strengths and phases of the equal parts transmitted over the respective reception paths (DP1, . . . ,DPN; Rx1, . . . ,RxN; AD1, . . . ,ADN) for the at least one transmission signal;

means for determining transmission factors of all other transmission paths and reception paths from known values of the transmission factors for the respective other transmission and reception paths and the measured strengths and phases of the equal parts transmitted over the respective reception paths; and means for compensating deviations of the measured transmission factors obtained from the measured strength and phase by changing weighting factors of a radiation pattern network (Tx-BFN, Rx-BFN).

4. The apparatus as defined in claim 3, wherein the dividing means (LT) is a Wilkinson divider provided with as many branch gates (VZ) as said reception paths and a reflection termination (RFX) on a central gate (T) connected with the branch gates (VZ).

5. The apparatus as defined in claim 4, further comprising means for switching from said reflection termination (RFX) to an absorption termination in order to be able to determine a coupling of the antenna elements (A1, . . . ,AN).

6. The apparatus as defined in claim 3, further comprising means for converting the equal parts of the at least one transmission signal coupled into the reception paths at the frequencies of the corresponding reception paths when a frequency shift exists between the transmission and reception paths.

* * * * *